US010889465B2

(12) United States Patent
Meguro et al.

(10) Patent No.: US 10,889,465 B2
(45) Date of Patent: Jan. 12, 2021

(54) MECHANICAL HOISTWAY ACCESS CONTROL DEVICE

(71) Applicant: Otis Elevator Company, Farmington, CT (US)

(72) Inventors: Daisuke Meguro, Tokyo (JP); Hiromitsu Miyajima, Chiba (JP); Takako Fukuyama, Narita (JP); Takero Kobari, Narita (JP)

(73) Assignee: OTIS ELEVATOR COMPANY, Farmington, CT (US)

( * ) Notice: Subject to any disclaimer, the term of this patent is extended or adjusted under 35 U.S.C. 154(b) by 566 days.

(21) Appl. No.: 15/664,462

(22) Filed: Jul. 31, 2017

(65) Prior Publication Data

US 2019/0031468 A1 Jan. 31, 2019

(51) Int. Cl.

| | |
|---|---|
| ***B66B 5/00*** | (2006.01) |
| ***B66B 13/16*** | (2006.01) |
| ***B66B 13/22*** | (2006.01) |
| ***B66B 13/12*** | (2006.01) |
| ***B66B 13/18*** | (2006.01) |
| ***B66B 13/20*** | (2006.01) |

(52) U.S. Cl.

CPC ..... *B66B 5/005* (2013.01); *B66B 13/12* (2013.01); *B66B 13/16* (2013.01); *B66B 13/22* (2013.01); *B66B 13/18* (2013.01); *B66B 13/20* (2013.01)

(58) Field of Classification Search

CPC ..... B66B 13/20; B66B 13/18; B66B 13/16

See application file for complete search history.

(56) References Cited

U.S. PATENT DOCUMENTS

| | | | |
|---|---|---|---|
| 5,476,157 | A | 12/1995 | Todaro |
| 5,727,657 | A | 3/1998 | Foelix |
| 7,954,606 | B2 | 6/2011 | Tinone et al. |
| 8,490,755 | B2 | 7/2013 | Lindberg |

(Continued)

FOREIGN PATENT DOCUMENTS

| | | | |
|---|---|---|---|
| CN | 101511716 | A | 8/2009 |
| CN | 104203795 | A | 12/2014 |
| CN | 204198152 | U | 3/2015 |

(Continued)

OTHER PUBLICATIONS

European Search Report for application EP 18186589.0, dated Jan. 31, 2019, 8 pages.

(Continued)

*Primary Examiner* — Diem M Tran

(74) *Attorney, Agent, or Firm* — Cantor Colburn LLP

(57) ABSTRACT

A mechanical hoistway access control device for an elevator landing door includes a first and a second base plates mounted on the hoistway side of a landing door panel and arranged in parallel with one another, a slider slidably arranged between the first and second base plates and configured to move in conjunction with a car door and configured to protrude out from a door closing side end of the landing door by a first elastic member to take an extended position when the landing door is opened with no elevator car at the landing, and a latch attached to the landing door and configured to engage with the slider to keep the slider in the extended position once the slider protrudes out from the door closing side end of the landing door.

15 Claims, 14 Drawing Sheets

(56) References Cited

U.S. PATENT DOCUMENTS

| | | | | |
|---|---|---|---|---|
| 9,272,878 | B2 | 3/2016 | Kocher et al. | |
| 2019/0100411 | A1* | 4/2019 | Meguro | B66B 13/16 |

FOREIGN PATENT DOCUMENTS

| | | | | |
|---|---|---|---|---|
| CN | 204938682 | U | | 1/2016 |
| CN | 205500481 | U | | 8/2016 |
| CN | 205855736 | U | | 1/2017 |
| CN | 106966279 | A | | 7/2017 |
| DE | 112012006072 | T5 | | 12/2014 |
| EP | 1110900 | B1 | | 7/2005 |
| EP | 1444161 | B1 | | 2/2006 |
| EP | 1863733 | B1 | | 12/2008 |
| EP | 1281654 | B1 | | 5/2012 |
| EP | 2671836 | A1 | | 12/2013 |
| EP | 2772462 | B1 | | 5/2015 |
| EP | 2743225 | B1 | | 2/2016 |
| FR | 2977881 | B1 | | 8/2015 |
| JP | 2007126225 | A | | 5/2007 |
| JP | 2010208739 | A | | 9/2010 |
| JP | 2013116807 | A | * | 6/2013 |
| JP | 6465248 | B2 | * | 2/2019 |
| WO | 2006082461 | A1 | | 9/2010 |
| WO | 2016178050 | A1 | | 11/2016 |

OTHER PUBLICATIONS

OTIS, "OTIS GeN2 Switch—The Elevator Reimagined", published Jan. 2, 2013; Retrieved from Internet; URL: http://www.otis.com/site/lb/OT_DL_Documents/OT_DL_DocumentLibrary/Gen2%20Switch/Gen2%20Switch.pdf; 13 pgs.

Chinese Office Action for Application No. 201810845542.7; dated Apr. 20, 2020; 7 Pages.

* cited by examiner

MECHANICAL HOISTWAY ACCESS CONTROL DEVICE

TECHNICAL FIELD

The present invention relates generally to a device for mechanically preventing engagement of an elevator landing door switch during elevator maintenance and inspection.

BACKGROUND ART

In general, an elevator landing door switch for preventing intrusion of a person in a hoistway through a landing door is provided on each landing door. The landing door switch is configured to be released by mechanically interlocking with an elevator car door when the elevator car door is opened on arrival of the elevator car at a landing. When one of the landing door switches is released, operation of the elevator car is interrupted. Once the elevator door is closed, the landing door switch is closed (i.e. electrically connected) accordingly, and the elevator system resumes operation of the elevator car. With such a configuration, not only can landing doors of an elevator be prevented from being opened improperly from the outside, but the operation of the elevator car can be interrupted appropriately when a landing door is opened on purpose or accidentally, thereby unforeseen accidents can be avoided in advance.

When a maintenance person enters a hoistway during maintenance and inspection of an elevator, a landing door switch is released by unlocking its lock device from the landing and opening the landing door manually, as known in the art. Therefore, the elevator car does not travel when the landing door is open.

However, in some elevators, the elevator car may resume operation once the landing door is completely closed during elevator maintenance, regardless of whether a maintenance person is in the hoistway. Further, even if the elevator has a safety switch in addition to the landing door switches, there is always a chance that a maintenance person may forget to operate the safety switch, since the method of operating a safety switch differs depending on types of elevators.

Therefore, there exists in the art a need for providing a safety device of an elevator which can reliably stop operations of the elevator car at the time of elevator maintenance and inspection. There also exists in the art a need for providing a safety device for elevators capable of retrofitting for any type of elevators.

SUMMARY OF INVENTION

According to one aspect of the present invention, a mechanical hoistway access control device for an elevator landing door is disclosed. The mechanical hoistway access control device includes a first and a second base plates mounted on the hoistway side of a landing door panel and arranged in parallel with one another, a slider slidably arranged between the first and second base plates and configured to move in conjunction with a car door and configured to protrude out from a door closing side end of the landing door by a first elastic member to take an extended position when the landing door is opened with no elevator car at the landing, and a latch attached to the landing door and configured to engage with the slider to keep the slider in the extended position once the slider protrudes out from the door closing side end of the landing door.

In some embodiments, the slider further comprises a tapered end oriented in a door closing direction of the landing door, and a cutout portion formed in the lower portion of the slider immediately behind the tapered end. The cutout portion is configured to engage with a corresponding receiver attached to a position adjacent to the door closing side end of the landing door panel when the landing door is closed after the landing door is once opened with no elevator car at the landing. The engagement of the cutout portion with the receiver mechanically locks opening and closing of the landing door.

In some embodiments, the mechanical hoistway access control device includes a landing door switch that locks the landing door when the landing door is closed.

In some embodiments, the slider includes a linkage member configured to be engaged with a car cam provided on the car door to move the slider in the door opening direction with the landing door to keep the slider in a retracted position during normal operation of the elevator car.

In some embodiments, the linkage member is a roller rotatably attached near a door opening side end portion of the slider on the hoistway side surface.

In some embodiments, the slider includes a latch groove provided in the upper side of the intermediate portion of the slider. The latch groove is configured to engage with the latch when the slider is in the extended position.

In some embodiments, the latch has a L-shaped configuration and is disposed at a position such that a shorter side portion of the L-shaped configuration is oriented in a door closing direction of the landing door and a longer side portion of the L-shaped configuration is oriented in the downward direction and overlaps with a door closing side portion of the slider to slidably hold the door closing side portion of the slider between the longer side portion of the latch and the landing door. The latch is pivotally attached to the landing door in the vicinity of a corner section of the L-shaped configuration. The latch groove is configured to engage with the shorter side portion of the latch when the slider is in the extended position.

In some embodiments, the shorter side portion of the latch has a thickness portion protruding against the landing door. The thickness of the thickness portion is slightly larger than the thickness of the slider. The thickness portion has a lower edge configured to be in slidable contact with the slider.

In some embodiments, the first elastic member is attached at one end to the latch near the corner section of the L-shaped configuration and attached at the other end to the slider near a door opening side end portion of the slider. The slider is held in a retracted position under a tension by the first elastic member so that the slider protrudes out from the door closing side end of the landing door when the landing door is opened with no elevator car at the landing.

In some embodiments, a second elastic member is attached at one end to the latch near the longer side end of the L-shaped configuration and attached at the other end to the first base plate arranged in the lower position than the second base plate near the intermediate portion of the first base plate. The second elastic member biases the latch in the latching direction.

In some embodiments, the mechanical hoistway access control device is disposed in proximity to the landing door switch.

In some embodiments, the first and the second base plates, the slider and the latch are formed of a steel plate.

In some embodiments, the first and the second base plates, the slider and the latch are disposed on a base member, and the mechanical hoistway access control device is attached to the upper portion of the landing door through the base member.

In some embodiments, the first elastic member is a spring.

In some embodiments, the second elastic member is a spring.

These and other aspects of this disclosure will become more readily apparent from the following description and the accompanying drawings, which can be briefly described as follows.

DESCRIPTION OF EMBODIMENTS

Figure 1:
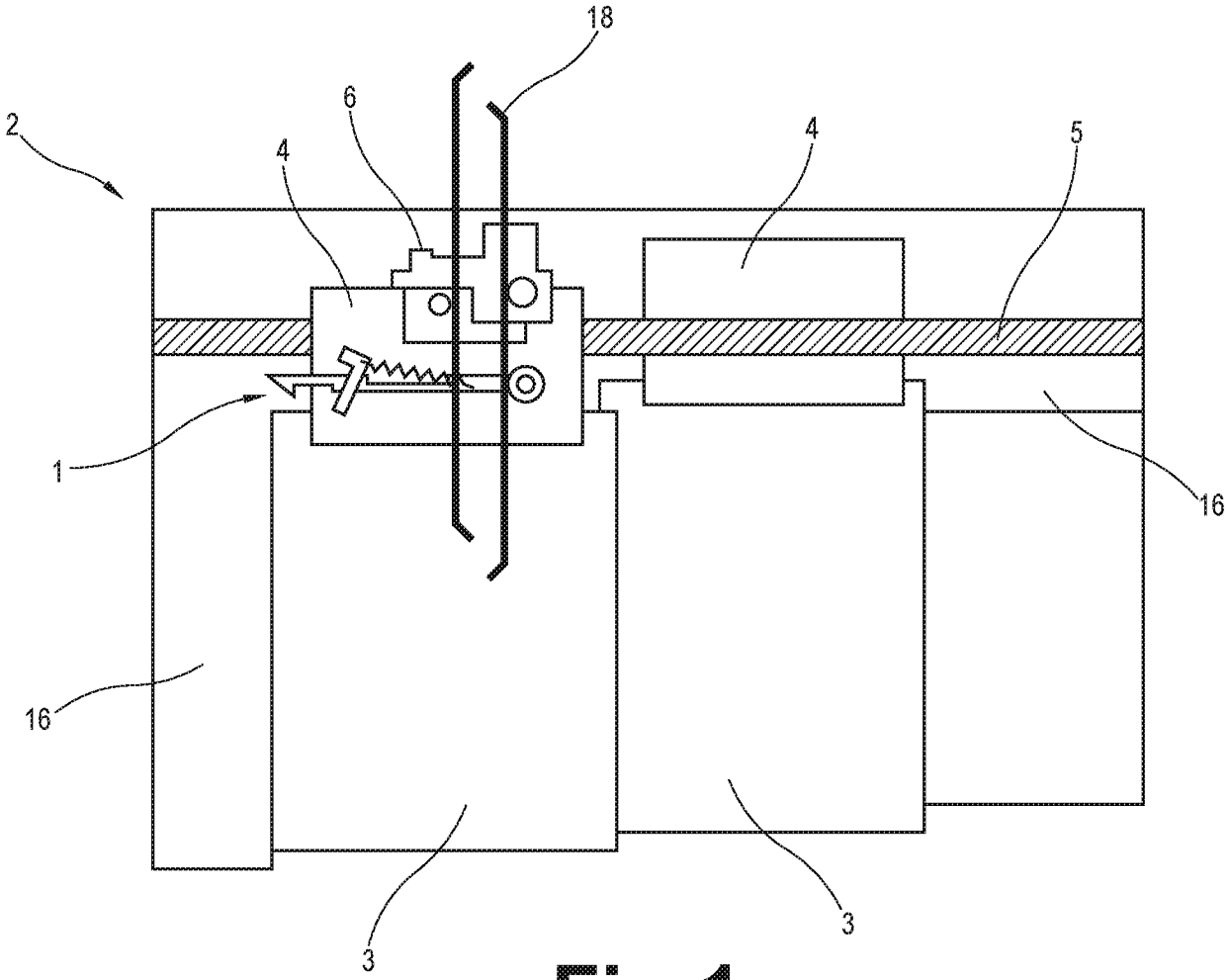
FIG. 1 is a schematic view showing one possible arrangement of a mechanical hoistway access control device (MHAD) in accordance with the present invention.

FIG. 1 shows the arrangement of a mechanical hoistway access control device (MHAD) 1 in accordance with the present invention located on a landing door 2, which is viewed from a hoistway.

In FIG. 1, the landing door 2 includes two door panels 3 and their respective door hangers 4 that are provided on the upper portion of the door panels 3 so as to support the door panels 3 on their respective door rails 5. When the landing door 2 is opened and closed, each door panel 3 slides to the right and left by means of a plurality of door rollers disposed within the corresponding door hanger 4 which move in the horizontal direction on the corresponding door rail 5. Two door rails 5 are fixed at the position on a door frame 16 on each floor of a building. Although the present invention will be described with reference to a landing door with lateral opening, it is to be understood that the present invention may be installed on a landing door with central opening.

Each landing door 2 is generally provided with a landing door switch 6. As shown in FIG. 1, the landing door switch 6 is generally placed on the door hanger 4. As is well known, each landing door switch 6 at each landing is electrically connected in series with each other with respect to an elevator control device, and the control device is configured to operate the elevator car only when the control device detects that all the landing door switches 6 are completely closed.

In FIG. 1, a mechanical hoistway access control device (MHAD) 1 in accordance with the present invention is disposed on the door hanger 4 below the landing door switch 6. However, the MHAD 1 may be disposed on the door hanger 4 above the landing door switch 6. It should be understood that the MHAD 1 may be placed at any appropriate position on the door hanger 4, provided that it does not intervene normal operation of the elevator.

Next, the configuration of the MHAD 1 in accordance with the present invention will be described with reference to FIG. 2.

Figure 2:
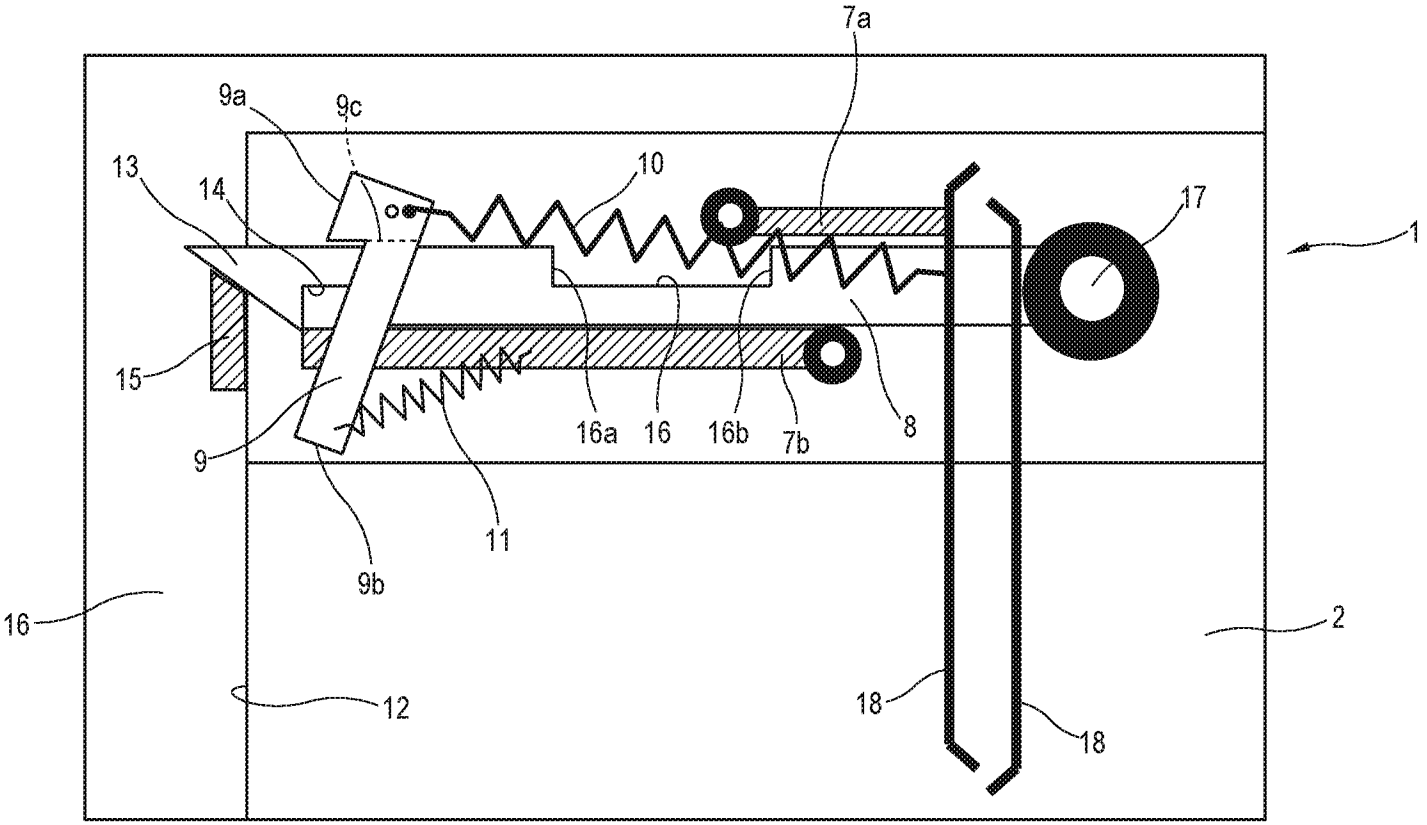
FIGS. 2 to 4 are schematic views showing various stages in the operation of the MHAD during normal operation of the elevator.

FIG. 2 is a schematic view of a portion of the landing door 2 viewed from a hoistway. According to one embodiment of the present invention, the MHAD 1 is provided with two base plates 7*a*, 7*b*, a slider 8, a latch 9, a first elastic member 10, and a second elastic member 11. In one example, the slider 8 may be formed of a steel plate and slidably arranged between two base plates 7*a*, 7*b*, which are arranged in parallel with each other and attached to a predetermined position on the door hanger 4. Likewise, two base plates 7*a*, 7*b* may be formed of a steel plate. In one example, each of the two base plates 7*a*, 7*b* may be fixed to the door hanger 4 by welding, adhesives, fasteners, bolts, etc.

FIG. 2 shows a state in which the slider 8 is disposed in a retracted position which does not protrude from the door closing side end 12 of the landing door 2. The door closing side end of the slider 8 (i.e. the left end of the slider 8 in FIG. 2) includes a tapered end 13 and a cutout portion 14 formed in the lower portion (i.e. the floor side) of the slider 8 immediately behind the tapered end 13. The tapered end 13 is oriented in a door closing direction of the landing door 2. The cutout portion 14 is formed such that when the slider 8 is arranged in the extended position, as will be described later, the cutout portion 14 engages with a corresponding receiver 15 attached to the landing door frame 16 adjacent to the door closing side end 12 of the landing door 2.

The latch 9 having a substantially L-shaped configuration is disposed at a position such that the shorter side end 9*a* of the L-shaped configuration is oriented in the door close direction of the landing door 2 and the longer side end 9*b* of the L-shaped configuration is oriented in the downward direction and overlaps with a door closing side portion of the slider 8. The latch 9 is pivotally attached to the door hanger 4 in the vicinity of the corner section of the L-shaped configuration. The latch 9 is arranged to slidably hold the door closing side portion of the slider 8 between the longer side portion 9*b* of the latch 9 and the door hanger 4. Further, the shorter side portion 9*a* of the latch 9 has a thickness portion protruding against the door hanger 4, the thickness of which is slightly larger than the thickness of the slider 8. The lower edge 9*c* of the thickness portion (shown by broken line in FIG. 2) is configured to be in slidable contact with the slider 8 so as to prevent the slider 8 from coming off upwardly.

A latch groove 16 having a predetermined length is provided in the upper side of the intermediate portion of the slider 8. As will be described later, the latch groove 16 is configured to engage with the shorter side portion 9*a* of the latch 9 when the slider 8 protrudes out from the door closing side end 12 of the landing door 2, i.e. when the slider 8 is in the extended position.

The first elastic member 10 (e.g. a spring) is attached at one end to the latch 9 near the corner portion of the L-shaped configuration and attached at the other end to the slider 8 near the door opening side end portion of the slider 8 (i.e. the right end side of the slider 8 in FIG. 2). As will be described later, the slider 8 is held in the retracted position under a tension by the first elastic member 10 so that the slider 8 protrudes out from the door closing side end 12 of the landing door 2 when a maintenance person opens the landing door 2 manually during elevator maintenance and inspection.

Furthermore, the second elastic member 11 (e.g. a spring) is attached at one end to the latch 9 near the longer side end 9*b* of the L-shaped configuration and attached at the other end to the lower base plate 7*b* around the intermediate portion. In FIG. 2, the second elastic member 11 biases the latch 9 in a counterclockwise direction, i.e., biases the latch in the latching direction.

A roller 17 is rotatably attached near the door opening side end portion of the slider 8 on the hoistway side surface of the slider 8. The roller 17 is arranged such that during normal operation of the elevator car the roller 17 is pushed in the door opening direction (i.e. to the right in FIG. 2) by the car cam 18 provided on the car door (not shown) in a known manner, and thereby the slider 8 as well as the entire MHAD 1 moves in the door opening direction with the landing door 2 while maintaining the retracted position.

In another embodiment, two base plates 7*a*, 7*b*, the slider 8 and the latch 9 are disposed in the predetermined position on a base member formed of a sheet metal. In this case, the MHAD 1 may be installed in any desired position on the door hanger 4 though the base member. The base member may be fixed to the door hanger 4 by welding, adhesives, fasteners, bolts, etc.

The operation of the MHAD 1 in accordance with the present invention will now be described with reference to FIGS. 2 to 14.

When the elevator car arrives at a landing during normal operation, the car cam 18 provided on the car door engages with a cam follower provided on the landing door 2 for opening and closing the landing door 2 in response to the movement of the car door, in a known manner. At this moment (FIG. 2), the car cam 18 also engages with the roller 17 on the slider 8.

Figure 3:
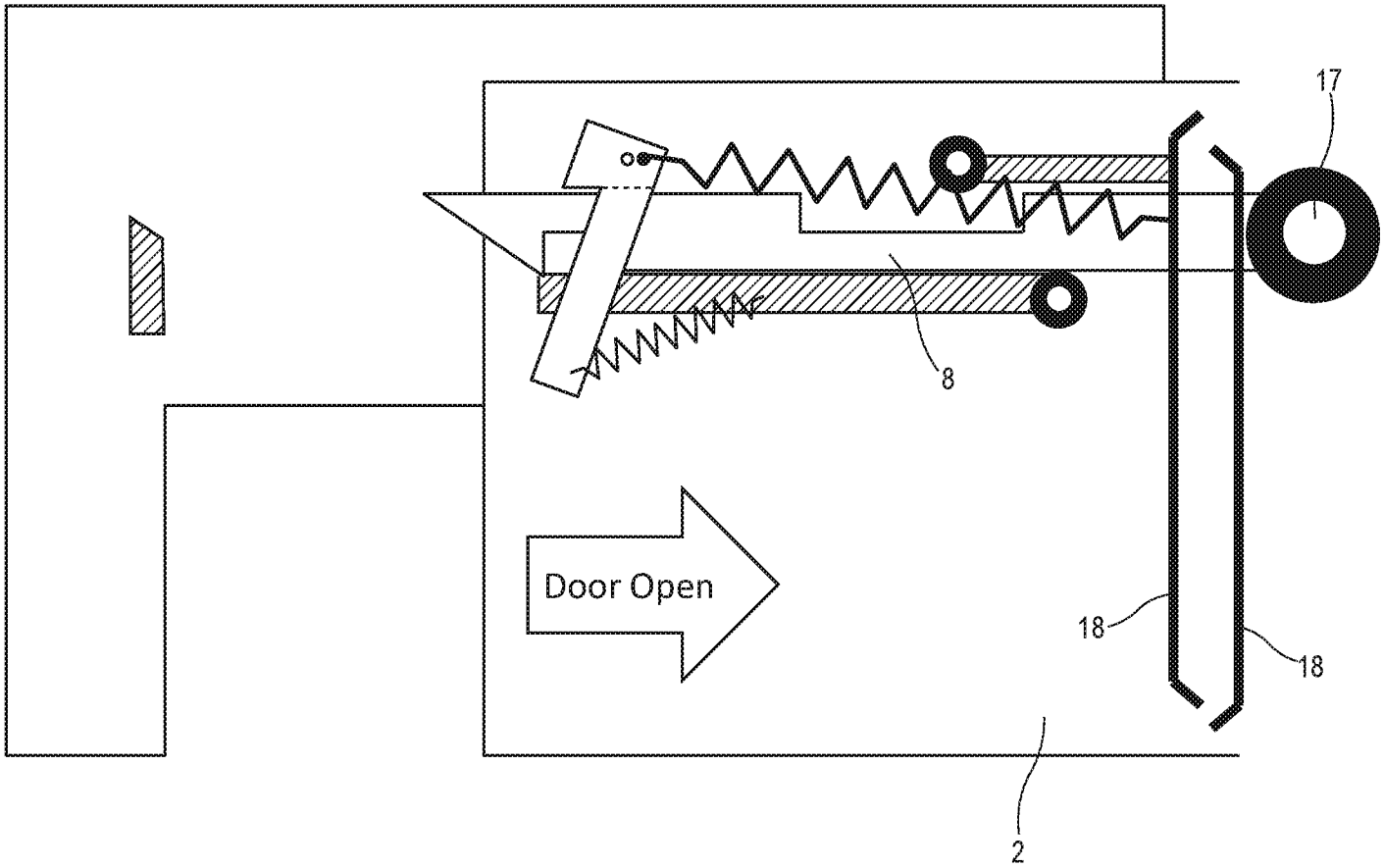

As is well known, in response to the movement of the car door in the door opening direction (FIG. 3), the car cam 18 releases (unlocks) the landing door switch 6 (FIG. 1) via the cam follower and pushes the cam follower in the door opening direction together with the roller 17 of the slider 8. As a result, the landing door 2 is opened in conjunction with the car door while the slider 8 is held in the retracted position by the car cam 18 (FIG. 3).

Figure 4:
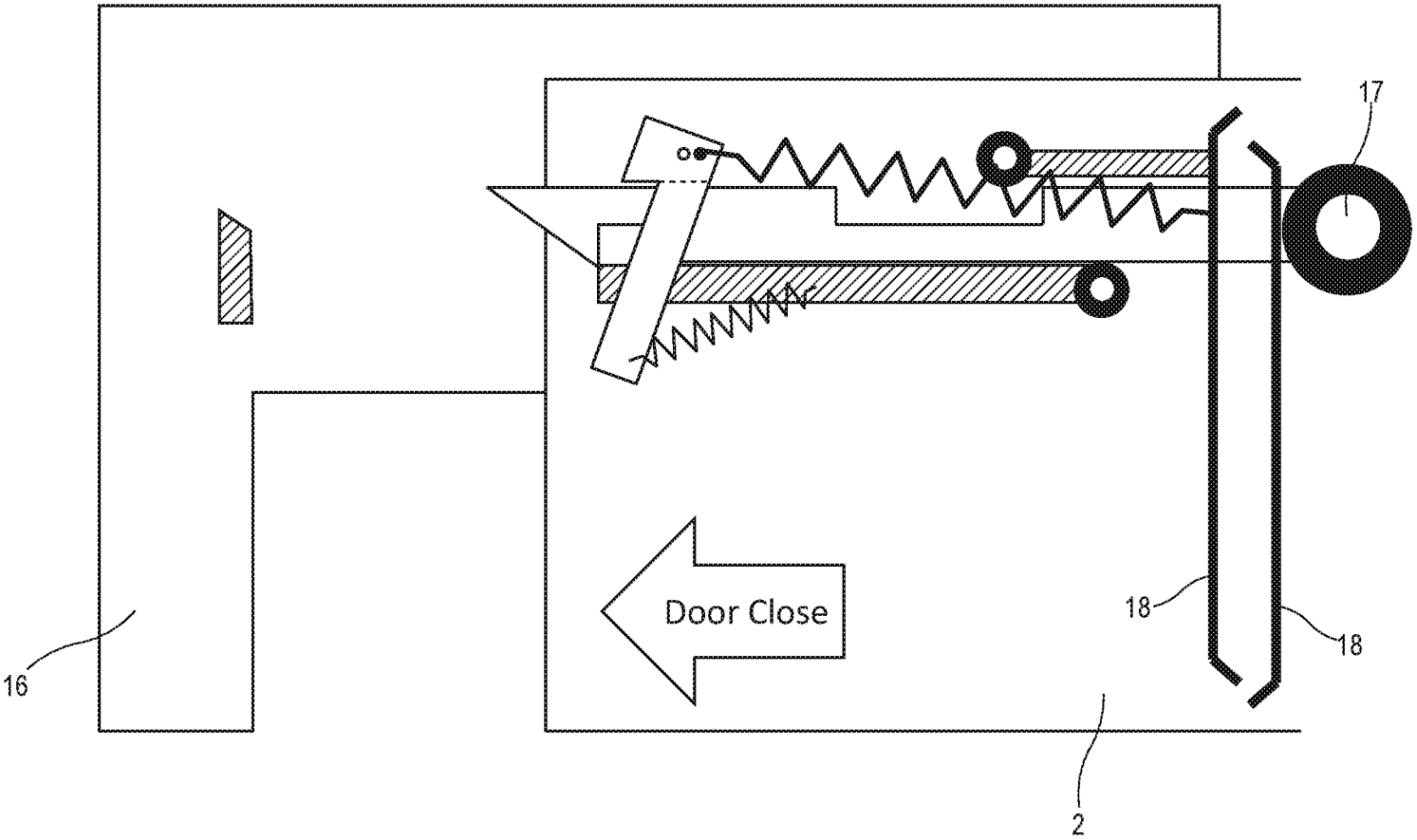
Figure 5:
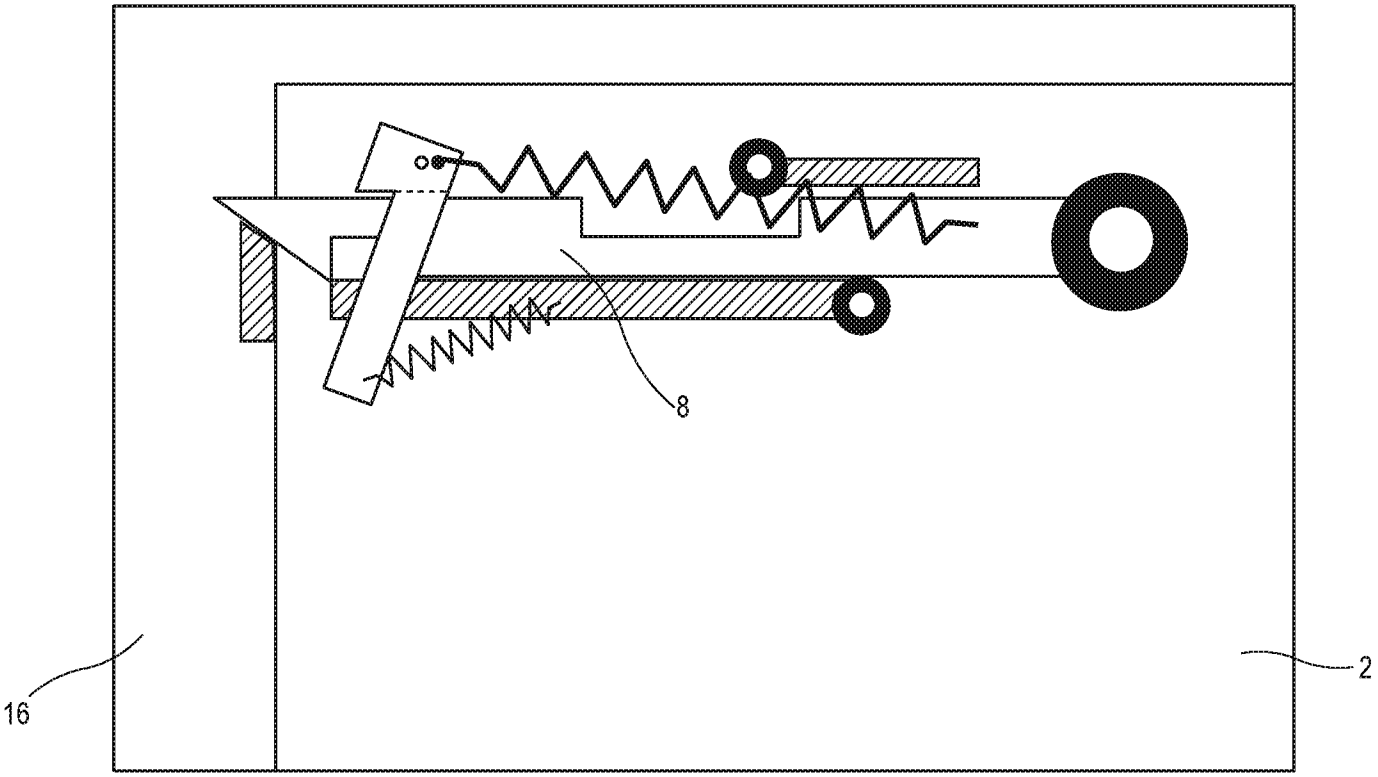
FIGS. 5 to 13 are schematic views showing various stages in the operation of the MHAD during elevator maintenance.

During door closing operation, the car door moves in the door closing direction (i.e. to the left in FIG. 4). In response to the movement of the car door in the door closing direction (FIG. 4), the car cam 18 pushes the cam follower in the door closing direction, thereby closing the landing door 2 in conjunction with the car door. At this moment, the landing door 2 is closed while the slider 8 is held in the retracted position by the car cam 18.

On the other hand, when a maintenance person enters a hoistway during maintenance and inspection of an elevator, the landing door 2 is opened manually by unlocking the door switch 6 from the landing using a key, as known in the art.

Figure 6:
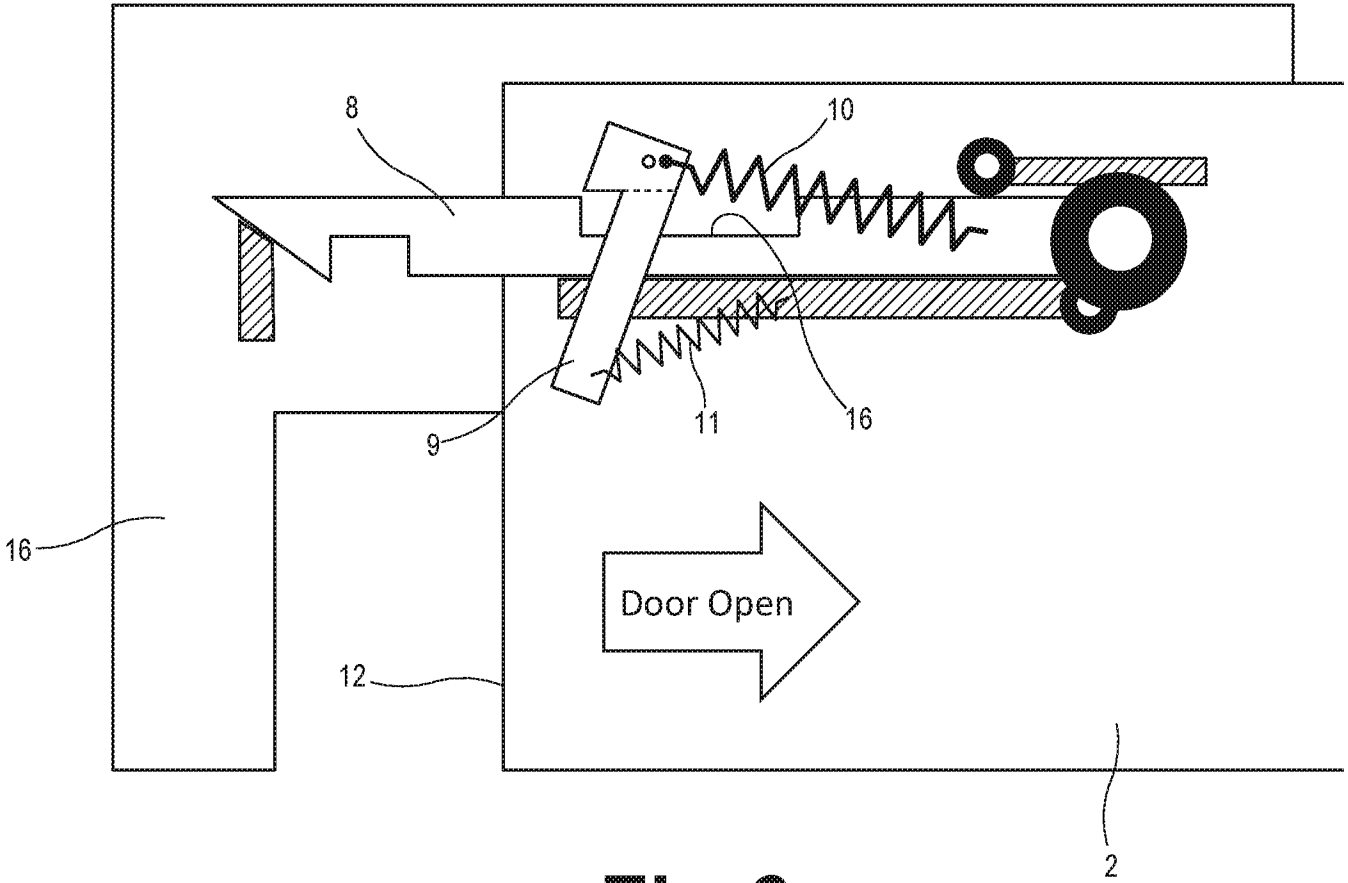

When the landing door 2 is moved in the door opening direction (to the right in FIG. 5) with no elevator car at the landing, the slider 8 protrudes out from the door closing side end 12 of the landing door 2 to the door closing direction, as shown in FIG. 6, by a tension of the first elastic member 10.

Figure 7:
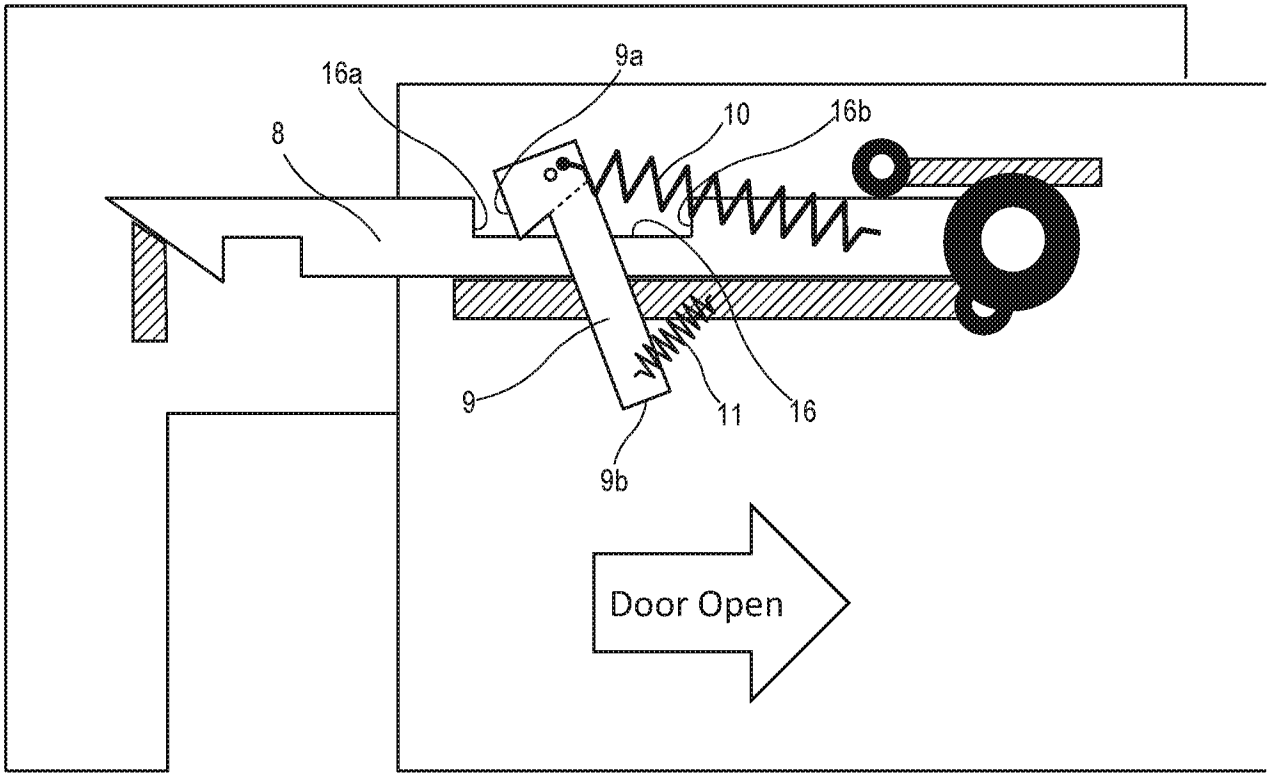

In response to the movement of the landing door 2 in the door opening direction, when the slider 8 protrudes up to a position where the latch groove 16 is immediately below the shorter side portion 9*a* of the latch 9 as shown in FIG. 6, the latch 9 is pivoted by a tension of the second elastic member 11 in the counterclockwise direction (i.e., into a latching direction) and thereby the latch 9 engages with the latch groove 16 as shown in FIG. 7. By providing the second elastic member 11, the engagement of the latch 9 with the latch groove 16 is ensured. However, it should be understood that the second elastic member 11 may be omitted. In this case, the shorter side portion 9*a* of the latch 9 may have a certain weight so that the shorter side portion 9*a* of the latch 9 engages with the latch groove 16 by its own weight.

Figure 8:
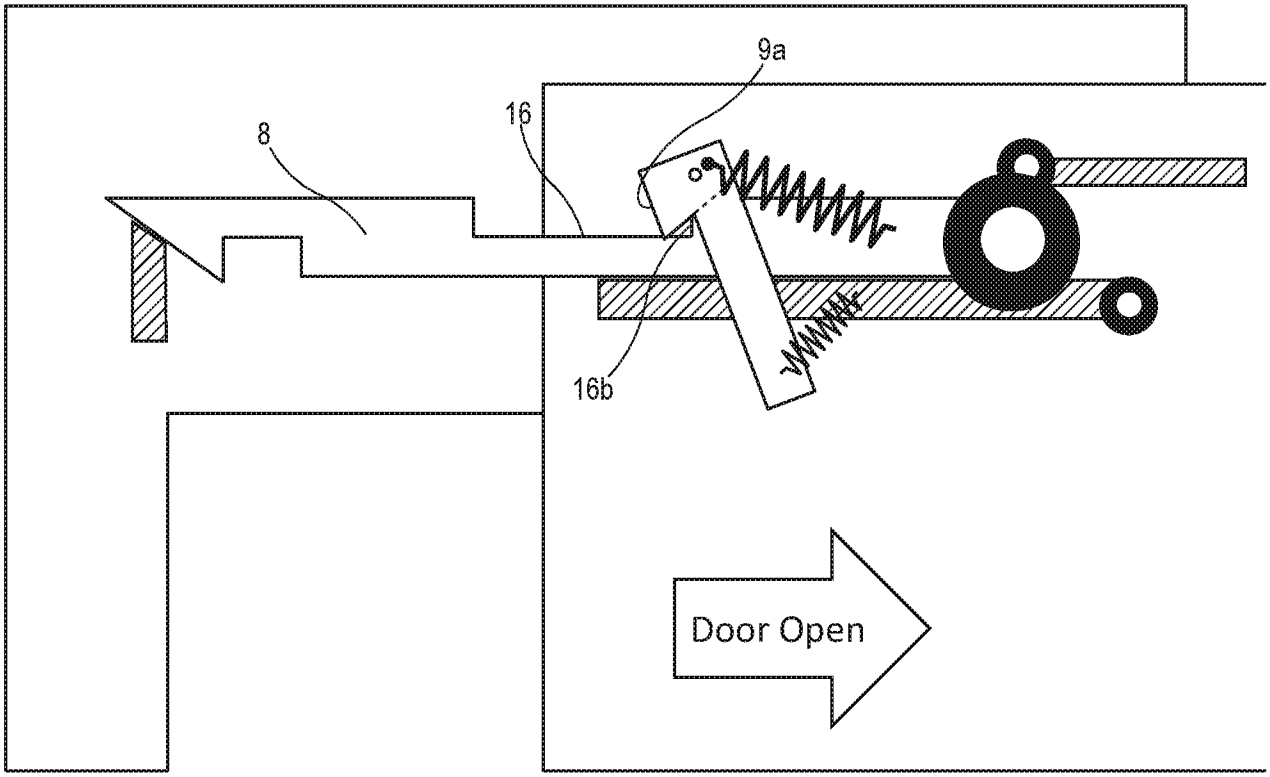
Figure 9:
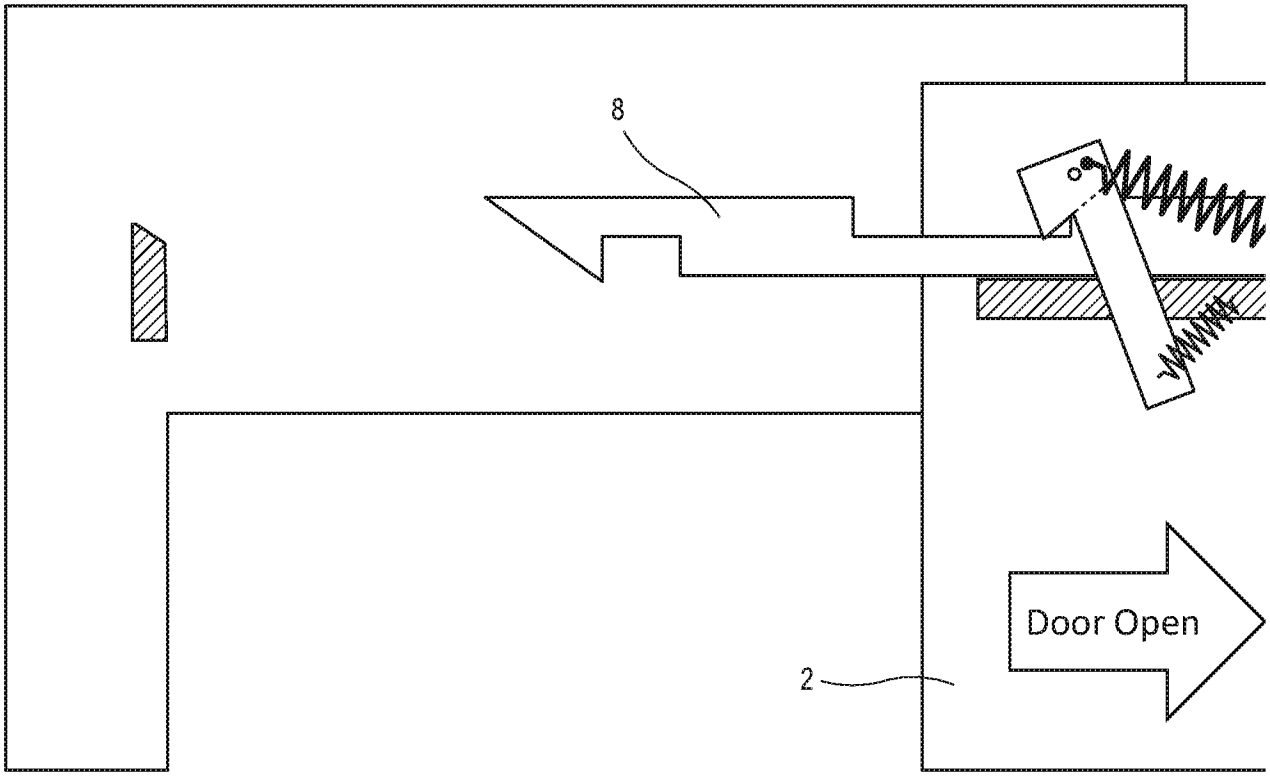

As shown in FIG. 8, once the slider 8 protrudes up to a position where the shorter side portion 9*a* of the latch 9 comes in contact with the door opening side end 16*b* of the latch groove 16 (i.e. the right end of the latch groove 16 in FIG. 8), the slider 8 does not protrude further in the door closing direction and maintains the position (i.e. the extended position) as shown in FIGS. 8 and 9 until the landing door 2 is closed.

Figure 10:
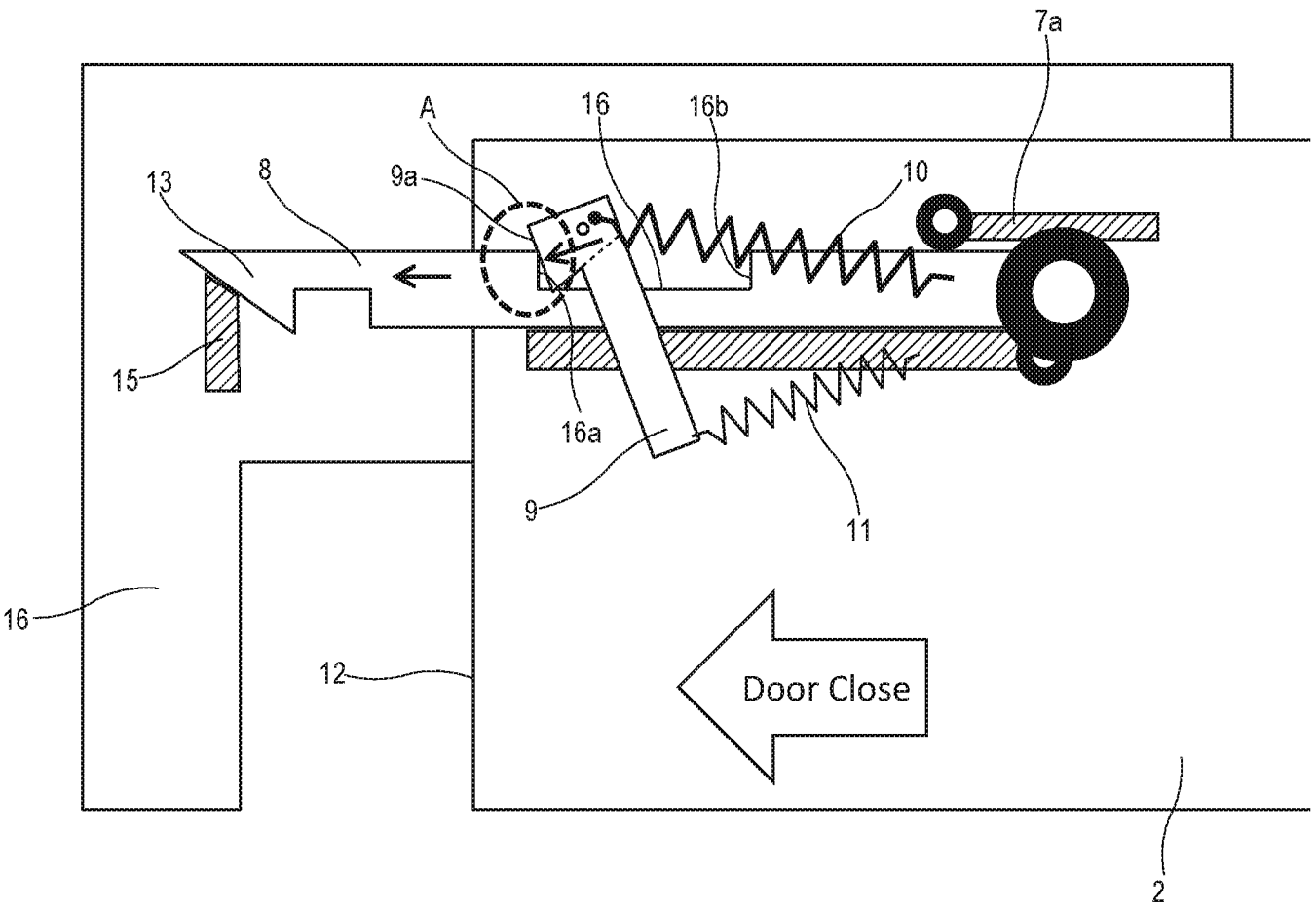

As shown in FIG. 10, when a maintenance person closes the landing door 2 from inside the hoistway during maintenance and inspection, the tapered end 13 of the slider 8 comes in contact with the receiver 15 which is attached to the landing door frame 16 adjacent to the door closing side end 12 of the landing door 2. Then, the slider 8 is pushed by the force of closing the landing door 2 back to the position where the shorter side portion 9*a* of the latch 9 comes in contact with the door closing side end 16*a* of the latch groove 16 (as shown by the broken circle A).

Figure 11:
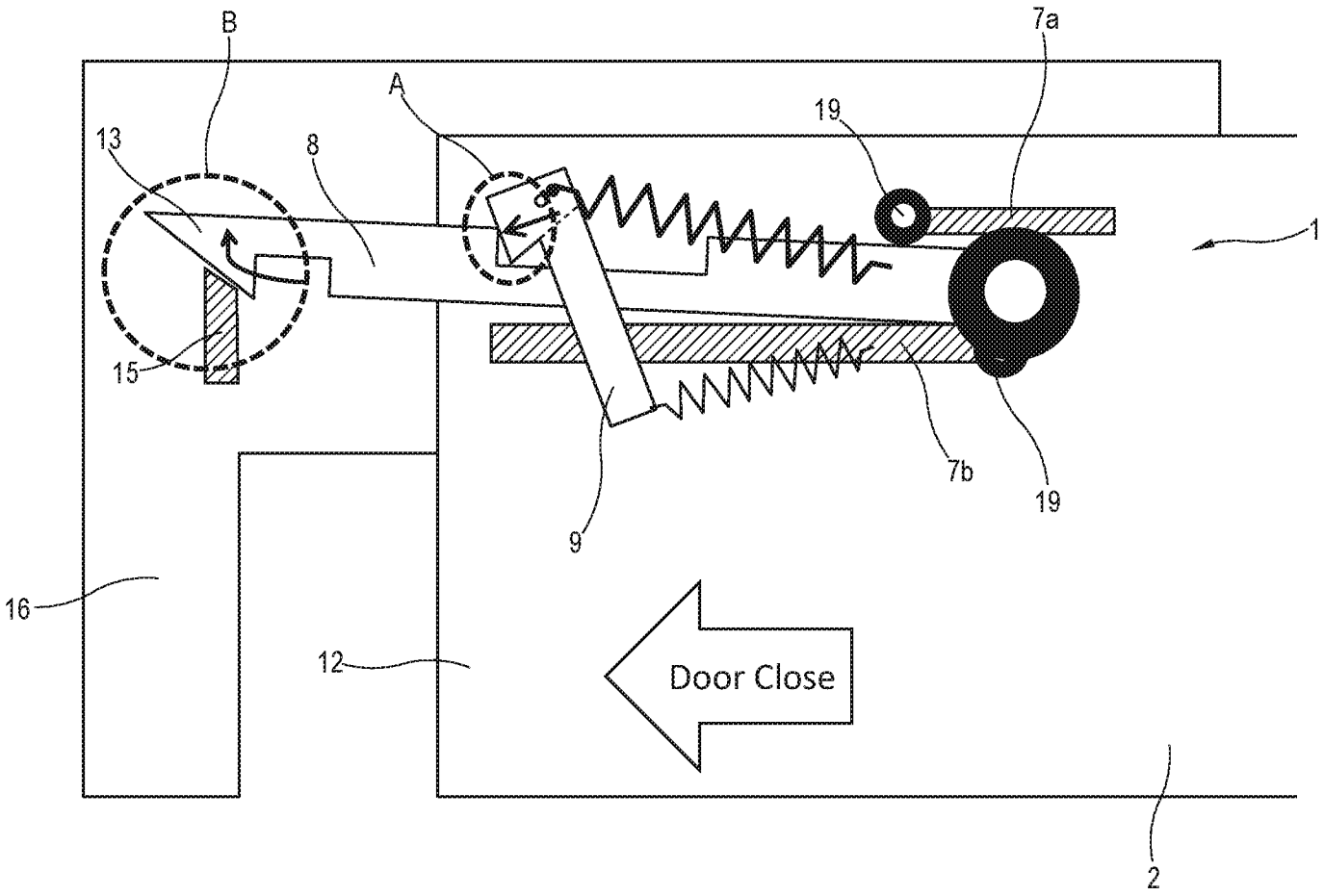

As shown in FIG. 11, the latch 9 fixing the slider 8 in the position (as shown by the broken circle A) ensures that the tapered end 13 of the slider 8 runs upon the receiver 15 (as shown by the broken circle B) when the tapered end 13 is pushed against the receiver 15 by the force of closing the landing door 2. At this moment, since the slider 8 slightly moves upward, the spacing between two base plates 7*a*, 7*b*, the length of each plate 7*a*, 7*b*, and the position of either longitudinal ends of each plate 7*a*, 7*b* may be determined so that the slider 8 does not get detached from the MHAD 1 when the tapered end 13 runs upon the receiver 15. Optionally, a roller 19 may be provided at the door opening side end (the right end in FIG. 11) of the lower base plate 7*b* and/or at the door closing side end (the left end in the figure) of the upper base plate 7*a*, in order to maintain better contact with the slider 8.

Figure 12:
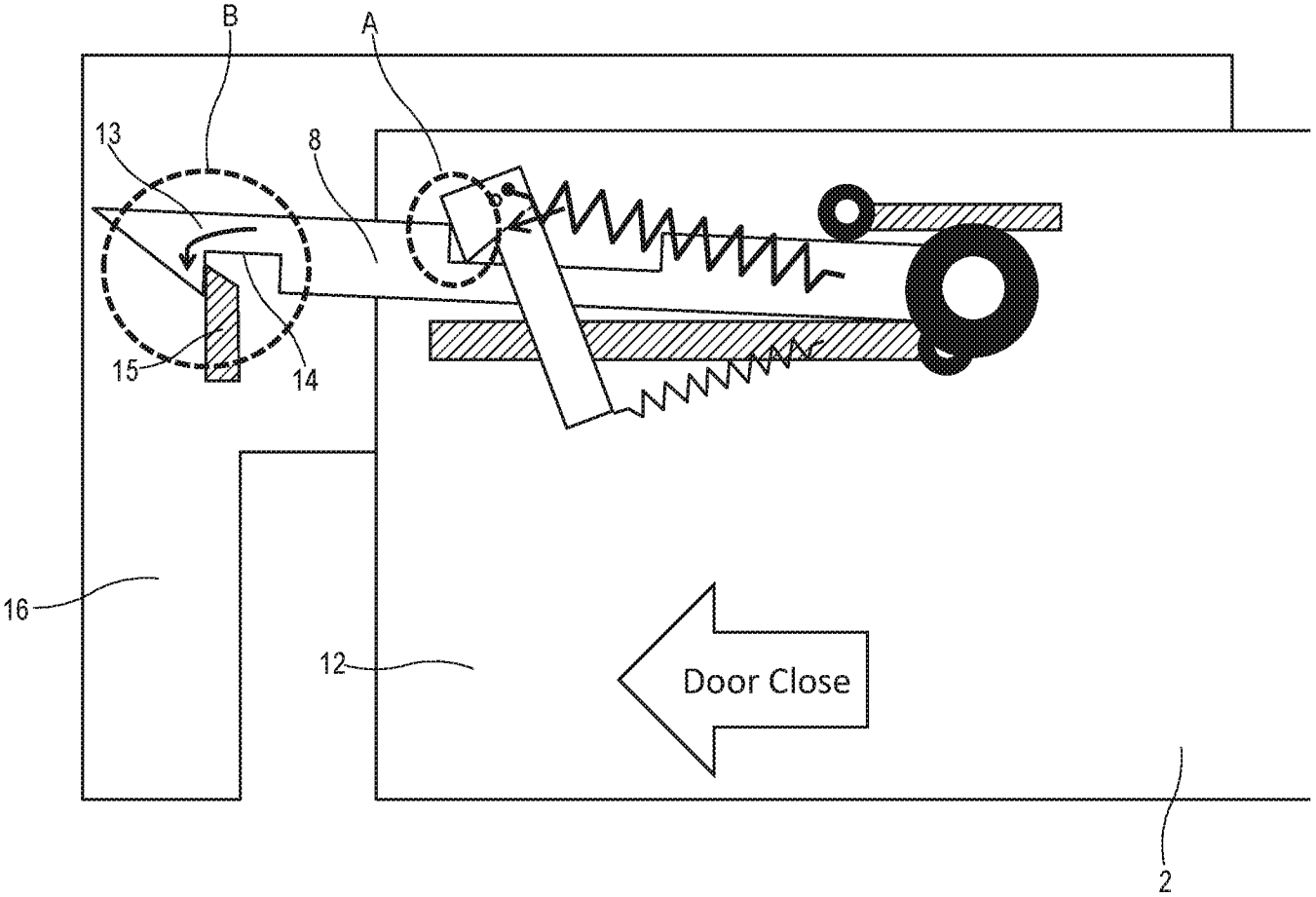

As shown in FIG. 12, as soon as the tapered end 13 runs on the receiver 15, the tapered end 13 drops downward by the weight of the slider 8 and then the cutout portion 14 engages with the receiver 15 (as shown by the broken circle B).

Figure 13:
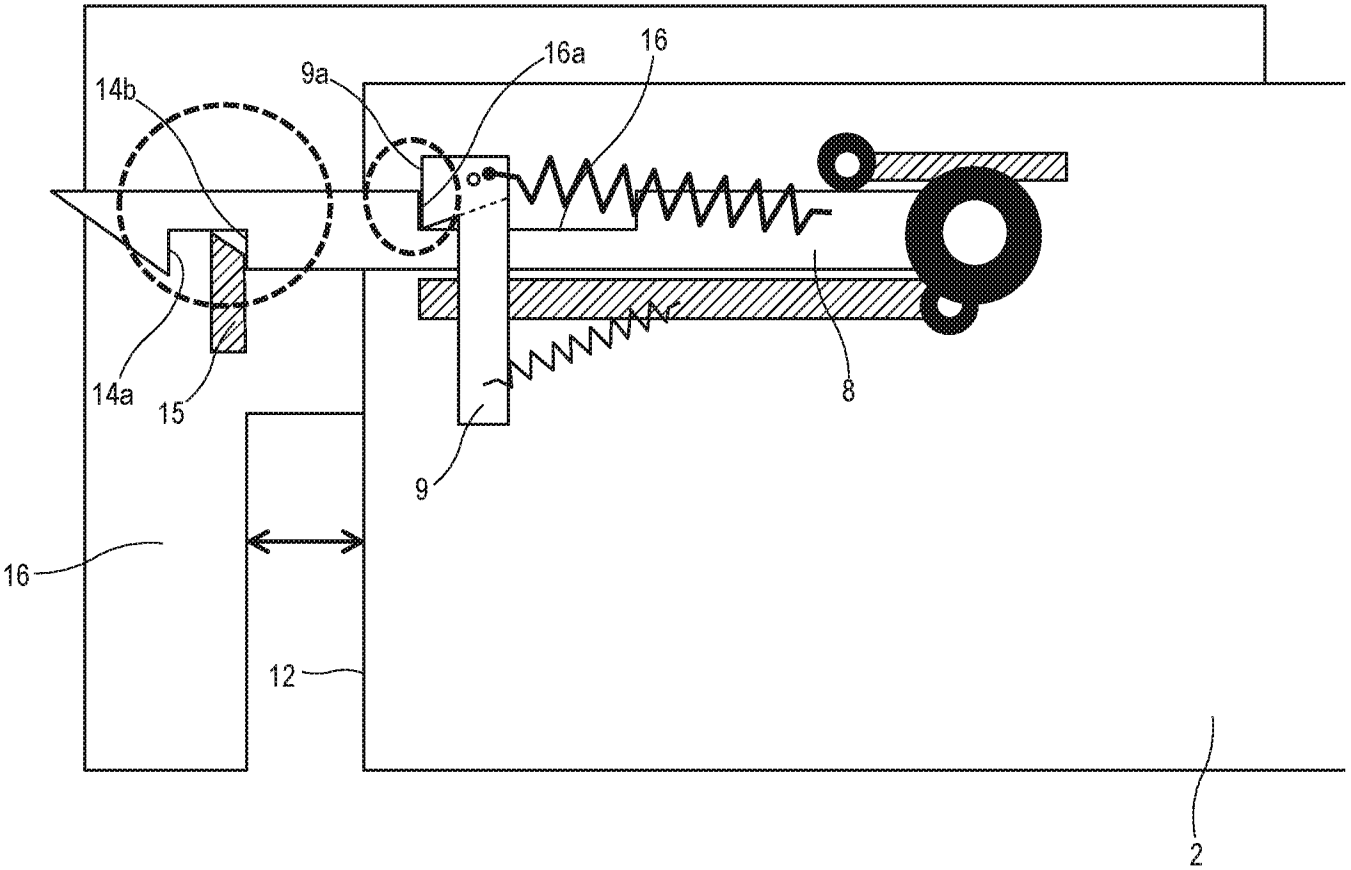

Then, as shown in FIG. 13, the door opening side end 14*b* of the cutout portion 14 engages with the receiver 15 while the shorter side end 9*a* of the latch 9 comes in contact with the door closing side end 16*a* of the latch groove 16. Therefore, the opening and closing of the landing door 2 is mechanically locked, leaving a slight gap between the door closing side end 12 of the landing door 2 and the landing door frame 16.

When unlocking or disengaging the slider 8 from the receiver 15, the latch 9 is turned from its latched position as shown in FIG. 13 to the unlatched position as shown in FIG. 6, and the slider 8 is moved from the extended position to the retracted position either from the inside or the outside of the hoistway manually using a corresponding key. Once the landing door 2 is completely closed manually from the outside of the hoistway after the maintenance and inspection of the elevator, the landing door switch is closed to enable normal operation of the elevator.

By mechanically locking the opening and/or closing of the landing door 2 leaving a slight gap between the landing door 2 and the door frame 16 during elevator maintenance and inspection, the engagement of the landing door switch 6 is mechanically blocked. Thus, the MHAD 1 of the present invention can securely block operations of an elevator car during maintenance and inspection of the elevator system, regardless of the model of elevator installed. Moreover, according to one embodiment of the present invention, since the door opening operation of the landing door 2 is also locked at the same time during elevator maintenance, the risk of a third person falling into the hoistway at the time of elevator maintenance can also be prevented. In particular, since the MHAD 1 of the present invention can mechanically block complete closing of the landing door 2, it ensures a temporary stop of the elevator car during maintenance and inspection of the elevator, even if a maintenance person has forgotten to activate a safety switch of the elevator.

The mechanical MHAD 1 of the present invention has a relatively compact, lightweight design applicable to almost all existing elevator systems having a car cam driven landing door, i.e. having a landing door operable in conjunction with a car door by means of a car cam. Furthermore, since the MHAD 1 of the present invention is configured to "mechanically" prevent the engagement of a landing door switch without using electrical equipment, any electrical control and complex wirings to hoistway is not required. Therefore, the MHAD 1 in accordance with the present invention can be retrofitted to almost all existing elevator systems.

Figure 14:
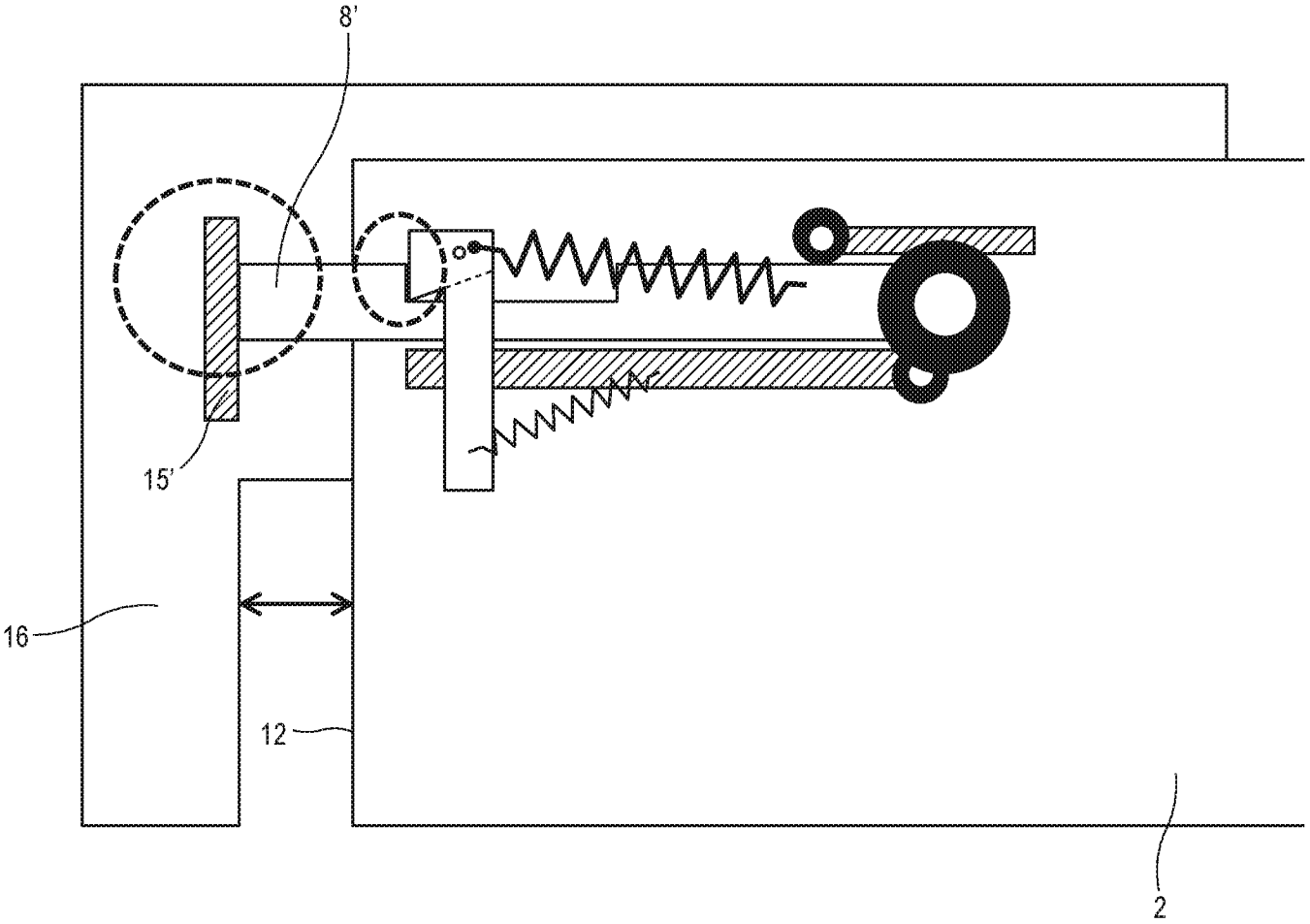
FIG. 14 is a schematic view of another embodiment of the MHAD.

In another embodiment of the present invention, the slider 8' may not include a tapered end 13 or a cutout portion 14. As shown in FIG. 14, the slider 8' does not engage with the stopper 15' attached to the landing door frame 16 but just comes in contact with the stopper 15' when the slider is in the extended position. The slider 8' is configured such that a maintenance person can freely open and close the landing door 2 during maintenance and inspection of the elevator, while preventing the landing door 2 and thus the landing door switch 6 from being completely closed.

Although the present invention has been described with reference to the configuration of the MHAD 1 made of a steel plate, the components of the MHAD 1 may be made of any members such as a bar or a rod-like member. Further, it should be understood that the composition of the MHAD 1 is not limited to the steel plate, and that the MHAD 1 can be manufactured using various materials such as carbon fiber, metal alloy, the combination of any known materials, and the like.

While the present invention has been particularly shown and described with reference to the exemplary embodiments as illustrated in the drawings, it will be recognized by those skilled in the art that various modifications may be made without departing from the spirit and scope of the invention as disclosed in the accompanying claims.

What is claimed is:

1. A mechanical hoistway access control device for an elevator landing door, comprising:

a first and a second base plates mounted on the hoistway side of a landing door panel and arranged in parallel with each other;

a slider slidably arranged between the first and second base plates, the slider configured to move in conjunction with a car door and configured to protrude out from a door closing side end of the landing door by a first elastic member to take an extended position when the landing door is opened with no elevator car at the landing; and a latch attached to the landing door and configured to engage with the slider to keep the slider in the extended position once the slider protrudes out from the door closing side end of the landing door, the slider kept in the extended position by the latch upon moving the landing door in a closing direction.

2. The mechanical hoistway access control device of claim 1, further including a landing door switch that locks the landing door when the landing door is closed.

3. The mechanical hoistway access control device of claim 2, wherein the mechanical hoistway access control device is disposed in proximity to the landing door switch.

4. The mechanical hoistway access control device of claim 1, wherein the slider includes a linkage member configured to be engaged with a car cam provided on the car door to move the slider in the door opening direction with the landing door to keep the slider in a retracted position during normal operation of the elevator car.

5. The mechanical hoistway access control device of claim 4, wherein the linkage member is a roller rotatably attached near a door opening side end portion of the slider on the hoistway side surface.

6. The mechanical hoistway access control device of claim 1, wherein the slider includes a latch groove provided in the upper side of the intermediate portion of the slider, the latch groove being configured to engage with the latch when the slider is in the extended position.

7. The mechanical hoistway access control device of claim 6, wherein the latch has a L-shaped configuration and is disposed at a position such that a shorter side portion of the L-shaped configuration is oriented in a door closing direction of the landing door and a longer side portion of the L-shaped configuration is oriented in the downward direction and overlaps with a door closing side portion of the slider to slidably hold the door closing side portion of the slider between the longer side portion of the latch and the landing door, the latch being pivotally attached to the landing door in the vicinity of a corner section of the L-shaped configuration, and wherein the latch groove is configured to engage with the shorter side portion of the latch when the slider is in the extended position.

8. The mechanical hoistway access control device of claim 7, wherein the shorter side portion of the latch has a thickness portion protruding against the landing door, the thickness of which being slightly larger than the thickness of the slider, the thickness portion having a lower edge configured to be in slidable contact with the slider.

9. The mechanical hoistway access control device of claim 7, wherein the first elastic member is attached at one end to the latch near the corner section of the L-shaped configuration and attached at the other end to the slider near a door opening side end portion of the slider, and wherein the slider is held in a retracted position under a tension by the first elastic member so that the slider protrudes out from the door closing side end of the landing door when the landing door is opened with no elevator car at the landing.

10. The mechanical hoistway access control device of claim 9, wherein a second elastic member is attached at one end to the latch near the longer side end of the L-shaped configuration and attached at the other end to the first base plate arranged in the lower position than the second base plate near the intermediate portion of the first base plate, and wherein the second elastic member biases the latch in the latching direction.

11. The mechanical hoistway access control device of claim 10, wherein the second elastic member is a spring.

12. The mechanical hoistway access control device of claim 1, wherein the first and the second base plates, the slider and the latch are formed of a steel plate.

13. The mechanical hoistway access control device of claim 1, wherein the first and the second base plates, the slider and the latch are disposed on a base member, and wherein the mechanical hoistway access control device is attached to the upper portion of the landing door through the base member.

14. A mechanical hoistway access control device for an elevator landing door, comprising:

a first and a second base plates mounted on the hoistway side of a landing door panel and arranged in parallel with each other;

a slider slidably arranged between the first and second base plates, the slider configured to move in conjunction with a car door and configured to protrude out from a door closing side end of the landing door by a first elastic member to take an extended position when the landing door is opened with no elevator car at the landing; and a latch attached to the landing door and configured to engage with the slider to keep the slider in the extended position once the slider protrudes out from the door closing side end of the landing door;

wherein the slider further comprises a tapered end oriented in a door closing direction of the landing door, and a cutout portion formed in the lower portion of the slider immediately behind the tapered end, wherein the cutout portion is configured to engage with a corresponding receiver attached to a position adjacent to the door closing side end of the landing door panel when the landing door is closed after the landing door is once opened with no elevator car at the landing, and wherein the engagement of the cutout portion with the receiver mechanically locks opening and closing of the landing door.

15. A mechanical hoistway access control device for an elevator landing door, comprising:

a first and a second base plates mounted on the hoistway side of a landing door panel and arranged in parallel with each other;

a slider slidably arranged between the first and second base plates, the slider configured to move in conjunction with a car door and configured to protrude out from a door closing side end of the landing door by a first elastic member to take an extended position when the landing door is opened with no elevator car at the landing; and a latch attached to the landing door and configured to engage with the slider to keep the slider in the extended position once the slider protrudes out from the door closing side end of the landing door;

wherein the first elastic member is a spring.

* * * * *